US005806130A

United States Patent [19]

Pascoe

[11] Patent Number: 5,806,130

[45] Date of Patent: Sep. 15, 1998

[54] DECORATING TOOL

[76] Inventor: Graciela C. Pascoe, 316 Willowpointe Dr., St. Charles, Mo. 63304

[21] Appl. No.: 779,675

[22] Filed: Jan. 7, 1997

[51] Int. Cl.[6] ..... B05C 17/02; B05C 17/10

[52] U.S. Cl. ..... 15/230.11; 15/210.5; 492/13; 492/19; 492/29; 492/30

[58] Field of Search ..... 15/230, 230.11, 15/210.5, 230.15, 230.16, 230.13; 492/13, 17, 19, 28–31, 33–36

[56] References Cited

U.S. PATENT DOCUMENTS

| | | | |
|---|---|---|---|
| 1,436,155 | 11/1922 | Domy | 101/376 |
| 1,464,512 | 8/1923 | Suhr | 101/376 |
| 2,305,671 | 12/1942 | McCaskie | 139/296 |
| 3,728,075 | 4/1973 | Cannan | 8/147 |
| 4,257,140 | 3/1981 | Downing | 15/230.11 |
| 4,930,179 | 6/1990 | Wright et al. | 15/230.11 |
| 5,117,529 | 6/1992 | Ohta | 15/230.11 |
| 5,206,979 | 5/1993 | Campbell | 492/13 |
| 5,471,703 | 12/1995 | Niven | 15/230.11 |
| 5,577,291 | 11/1996 | Myers et al. | 15/230.11 |

FOREIGN PATENT DOCUMENTS

| | | | |
|---|---|---|---|
| 9002017 | 4/1991 | Netherlands | 15/230.11 |
| 93/14879 | 8/1993 | WIPO | 15/230.11 |

*Primary Examiner*—Mark Spisich
*Attorney, Agent, or Firm*—Grace J. Fishel

[57] ABSTRACT

A decorating tool for use by painters in ragging a previously painted surface. The tool includes a sleeve elasticated to a roller which can be mounted on a conventional roller handle assembly. The sleeve is formed of a rag material and has a diameter and a length exceeding the diameter and length of the roller. The sleeve is gathered by a plurality of elastic bands that are axially spaced apart along the length of the roller and threaded in the rag material in a wave pattern to form random folds.

10 Claims, 2 Drawing Sheets

DECORATING TOOL

BACKGROUND OF THE INVENTION

1. Field of the Invention

The present invention relates to a tool that can be used by painters of all skill levels for ragging a previously painted surface, quickly and easily, to produce a satisfactory random pattern.

2. Brief Description of the Prior Art

Rag rolling and ragging are different techniques for applying a wallpaper-like design to a previously painted surface. Rag rolling gives rise to a vertical repeat pattern whereas ragging produces a random design. A novice can achieve satisfactory results with rag rolling but ragging requires intermediate to advanced skills.

In rag rolling, a thin coat of paint is applied and rag strips rolled over the paint while it is wet, removing some of it, leaving behind a regular repeat pattern. On large areas, such as a wall, a plumb line should be established for the first rag-rolled line, which need not be straight but must be vertical as rag-rolled lines will be very noticeable if they go off at an angle. Since the paint must be rag rolled shortly after it is applied, an area roughly four feet wide can be worked at a time. Because of this limitation, it is best if two persons work together, the first applying the thin coat of paint, the second rag rolling a portion of it off. The process is messy and generates a pile of paint soaked rags.

In ragging, a small rag is dipped into paint, excess paint squeezed out and the rag crumpled loosely. The rag is then gently pressed on a previously painted surface and rolled in a random pattern. Since the pattern depends on the folds in the rag, it is very difficult to maintain a consistent pattern and for that reason ragging of large areas requires intermediate or advanced skills. The process is also very time consuming. For example, it may take an experienced painter eight hours to rag the walls of a room measuring 10 by 12 feet.

SUMMARY OF THE INVENTION

In view of the above, there is a need for a decorating tool that can be used by skilled as well as novice painters to quickly rag a large area, producing a random pattern in a consistent manner. There is also a need for a tool that does not require the user to touch the rag during painting, making for a cleaner application.

It is an object of the present invention to provide a decorating tool that can be used to rag a large area quickly and easily, good results being achievable even by a novice. It is another object to provide a decorating tool that is less messy to use for ragging. Other objects and features of the invention will be in part apparent and in part pointed out hereinafter.

In accordance with the invention, a decorating tool for use in connection with an ordinary roller handle assembly having a rotating cage includes a roller which is rotatably mounted on the rotating cage. A sleeve formed of rag material is elasticated to the roller. The sleeve has a diameter and a length exceeding the diameter and length of the roller and is gathered by a plurality of axially spaced apart elastic bands forming a wave pattern.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
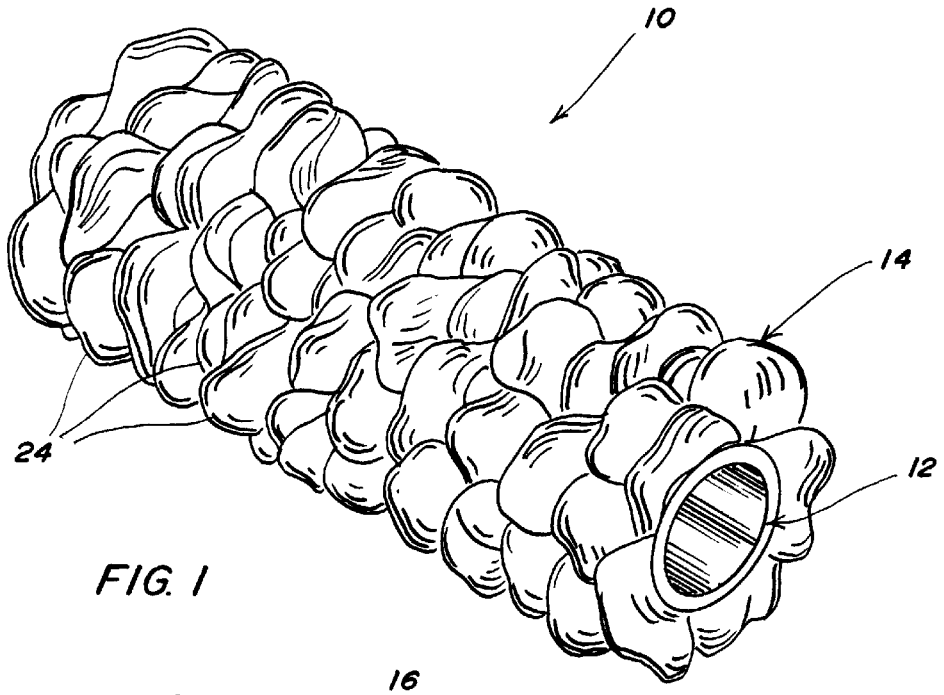
FIG. 1 is a perspective view of a decorating tool in accordance with the present invention, the tool comprising in major part a roller and a sleeve.

Referring to the drawings more particularly by reference character, reference number 10 refers to a decorating tool for ragging a previously painted surface in accordance with the present invention. Tool 10 includes a roller 12 covered by a sleeve 14.

Roller 12 is adapted to be rotatably mounted on a paint roller handle assembly (not shown), conventionally including a handle or an arm and a rotating cage. Roller 12 is a hollow cylindrical tube that fits snugly over the cage, rotating with the cage as the roller handle assembly is rolled over a surface to be decorated. Roller 12 may be formed of paperboard, plastic or the like.

Sleeve 14 may be formed of any rag material, preferably containing at least some cotton or the like, and is generally cylindrically shaped, having a diameter and a length substantially greater than the diameter and length of roller 12. It will be understood that while sleeve 14 is referred to as being generally cylindrically shaped, this is to be loosely interpreted to include other shapes, such as elliptical cross-sections and the like. Further, the term "rag material" as used herein has expansive meaning to include other materials besides the preferred cloth-like materials that are indicated hereinabove with respect to the preferred embodiment. That is, rag materials include other absorbent materials, such as chamois and foam sheet, as well as nonabsorbent materials, such as plastic or aluminum foils, which, while not absorbent, provide interesting effects when gathered on the roller and then rolled in a manner discussed below.

Figure 2:
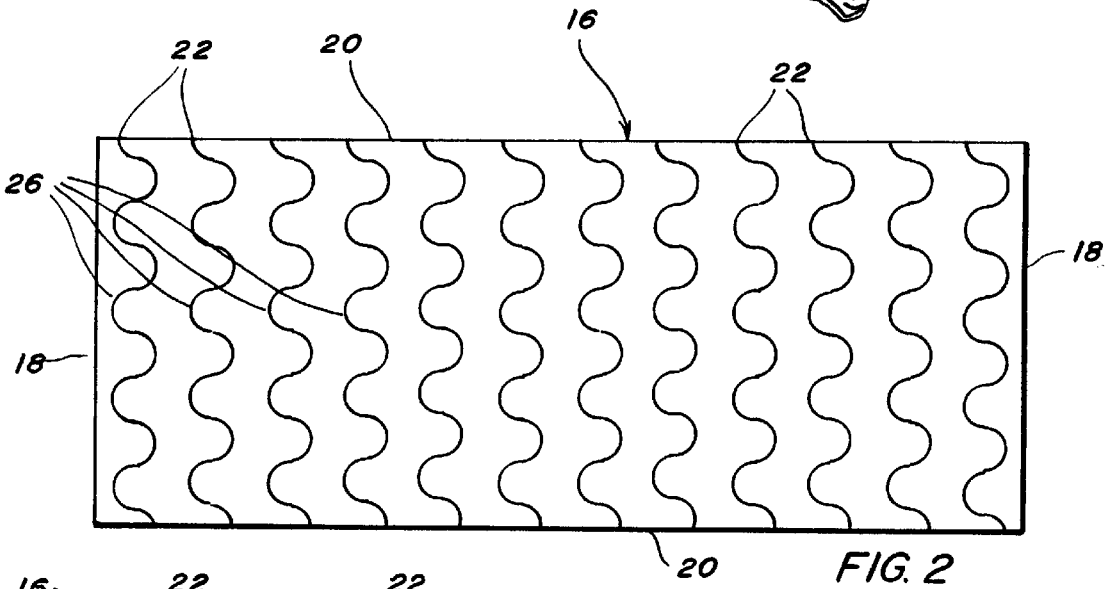
FIG. 2 is plan view of the sleeve shown flattened before it is gathered.
Figure 3:
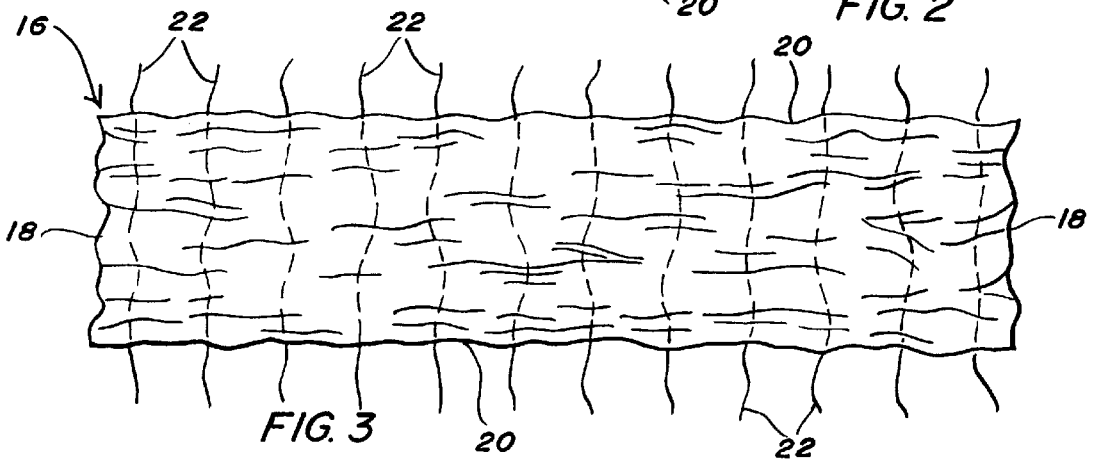
FIG. 3 is a plan view of the sleeve shown flattened after it is gathered.

In the form illustrated in FIGS. 2 and 3, sleeve 14 is formed from a rectangular sheet 16 having end edges 18 and side edges 20. Side edges 20 are joined together to form sleeve 14 by some suitable method such as by sewing, gluing, etc. It will understood, however, that sleeve 14 may be formed as a tube initially, such as by knitting or extrusion, thereby obviating the need for joining side edges 20. Sleeve 14 is fitted over roller 12 and elasticated to the roller with a plurality of axially spaced apart elastic bands 22, the end-most ones of which may be adjacent end edges 18.

When sleeve 14 is threaded over roller 12, it is important that the rag material between adjacent bands 22 fall into irregular folds 24. If bands 22 are parallel, for example, the rag material between adjacent bands will form a paint stripe, not a random pattern, when rolled over a surface. Bands 22 are therefore formed in a wave pattern 26, preferably in-phase and serpentine. It will be understood, however, that wave pattern 26 may be square, saw toothed and so forth, regular or irregular, repeating or non-repeating. A similar effect can be obtained with spaced apart rubber bands which are not attached the sheet; however, it takes a great deal of pulling and twisting to get the rag material to fall into acceptable folds, making the tool impractical.

Figure 4:
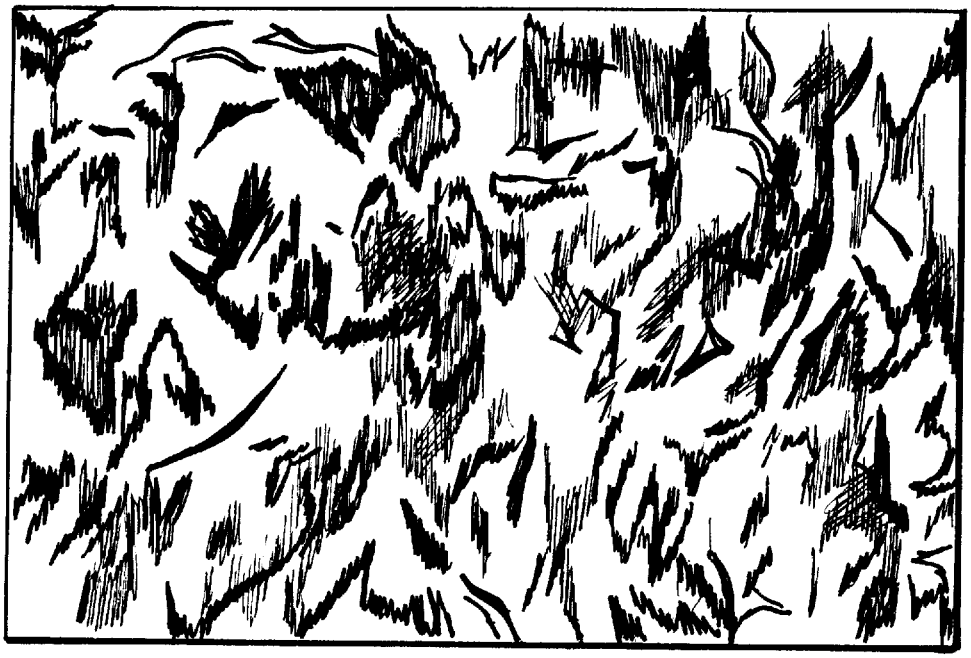
FIG. 4 (PRIOR ART)
FIG. 4 is a ragging pattern made with a conventional rag.

In the best mode presently known for practicing the invention, bands 22 gathering sheet 16 are formed with a running stitch of elastic thread. As shown in FIG. 2, pattern 26 has a sine wave shape with the waves spaced apart a distance about the same as the distance between the maximum and minimum of each wave. The threads are pulled, gathering the material as shown in FIG. 4 before side edges 20 are joined, thereby elasticating sleeve 14 for attachment to roller 12.

It has been found that a sheet 16 measuring about 16 by 36 inches can be used on a roller 12 having an outside diameter of about 2 inches. It will be readily appreciated, however, that the present invention is not limited to the foregoing specifics, which are provided only by way of example, and that a roller with a smaller diameter will have deeper folds 24 between the bands, whereas a roller with a larger diameter will have less deep folds. The same effect on the size of folds 24 can be had by increasing or decreasing the width or length of sheet 16, as will be readily understood.

The surface to be ragged is prepainted, usually with a color that is lighter than the color of the paint to be ragged on. A particularly satisfactory result can be obtained by painting the surface with a flat paint, allowing it to dry completely, and then using a glossy or semi-glossy paint for ragging. The paint to be ragged on may be diluted with water or with solvent so that it forms a translucent glaze of the desired intensity.

Figure 5:
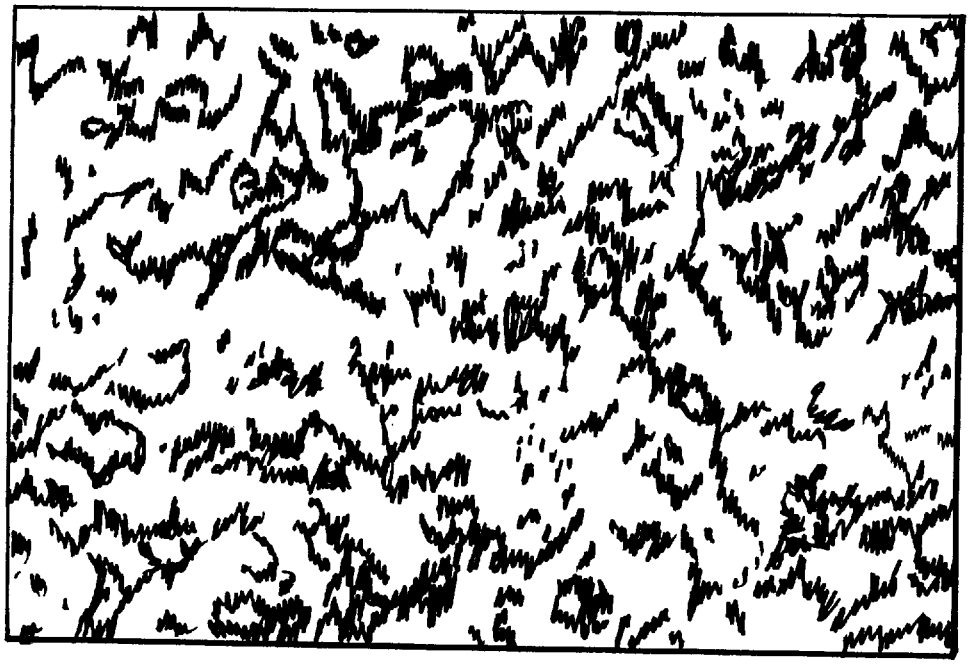
FIG. 5 is a ragging pattern made with the decorating tool of the present invention.

In use, decorating tool 10 is slipped on the rotating cage of a roller handle assembly. Paint is then placed on decorating tool 10 with a paint brush or spatula (depending on the consistency of the paint). The decorating tool 10 is then rolled over a piece of newspaper, scrap wallboard or the like to evenly spread the paint on sleeve 14, and remove excess paint. When the paint has been evened on sleeve 14, the decorating tool is rolled onto the wall. Because the folds between bands 22 are of similar size but irregular, decorating tool 10 can be rolled at any angle. It is preferred, however, to roll decorating tool 10 from top to bottom of a wall and then to make a second pass at a right angle thereto, forming a random but consistent pattern as shown in FIG. 5 in contrast to the pattern shown in FIG. 4 formed by ragging with an ordinary cloth. The time required to rag a surface with decorating tool 10 is reduced substantially, by 50 percent or more, over the time required for conventional ragging. In addition, the application is cleaner as the user does not have to touch the rag material with his or her hands.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A decorating tool suitable for ragging a previously painted surface comprising a roller adapted to be rotatably mounted on a paint roller handle assembly, and a sleeve covering the roller, said sleeve formed of rag material and having a diameter and a length exceeding the diameter and length of the roller, said sleeve gathered by a plurality of elastic bands, said bands axially spaced apart along the length of the roller and threaded in the rag material in a wave pattern.

2. The tool of claim 1 wherein the wave pattern is in-phase.

3. The tool of claim 2 wherein the wave pattern is serpentine.

4. The tool of claim 1 wherein the rag material is an absorbent cloth material.

5. The tool of claim 3 wherein the sleeve is at least twice the diameter and length of the roller.

6. The tool of claim 5 wherein the roller has an outside diameter of about 2 inches and the sleeve is formed from a sheet of material measuring about 16 by 36 inches.

7. A decorating tool suitable for ragging a previously painted surface comprising a roller adapted to be rotatably mounted on a paint roller handle assembly, and a sleeve covering the roller, said sleeve formed of absorbent rag material and having a diameter and a length exceeding the diameter and length of the roller, said sleeve gathered by a plurality of elastic bands, said bands axially spaced apart along the length of the roller and threaded in the rag material in a regular sine wave pattern.

8. The tool of claim 7 wherein said pattern has a maximum and a minimum and said waves are spaced apart a distance about the same as the distance between the maximum and the minimum of the waves.

9. The tool of claim 8 wherein said waves are in phase.

10. The tool of claim 9 wherein the rag material contains some cotton fiber.

* * * * *